US012690627B2

(12) United States Patent
Perry et al.

(10) Patent No.: US 12,690,627 B2
(45) Date of Patent: Jul. 28, 2026

(54) LOWER TORSO GARMENT INCLUDING A POUCH

(71) Applicant: HBI Branded Apparel Enterprises, LLC, Winston-Salem, NC (US)

(72) Inventors: Tasha R. Perry, Winston-Salem, NC (US); Sherry E. Kimel, King, NC (US); Melissa A. Coleman, Kernersville, NC (US); Rachel I. Erickson, Winston-Salem, NC (US); Frances S. Boyd, Winston-Salem, NC (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 0 days.

(21) Appl. No.: 18/336,401

(22) Filed: Jun. 16, 2023

(65) Prior Publication Data

US 2023/0329356 A1 Oct. 19, 2023

Related U.S. Application Data

(63) Continuation of application No. 16/014,925, filed on Jun. 21, 2018, now abandoned.

(51) Int. Cl.
*A41B 9/02* (2006.01)
*A41B 17/00* (2006.01)

(52) U.S. Cl.
CPC ..... *A41B 9/02* (2013.01); *A41B 17/00* (2013.01)

(58) Field of Classification Search
CPC .. A41B 9/02; A41B 9/00; A41B 9/026; A41B 9/001; A41B 9/004; A41B 9/023; A41B 17/00
See application file for complete search history.

(56) References Cited

U.S. PATENT DOCUMENTS 1,283,006 A * 10/1918 Willcox ..... A41B 9/02 2/405
5,819,323 A * 10/1998 Edenfield ..... A41B 9/02 2/403

(Continued)

FOREIGN PATENT DOCUMENTS

CA 2344975 A1 10/2002
CA 2416557 A1 7/2004

(Continued)

OTHER PUBLICATIONS

Office Action Issued for Mexican Patent Application No. MX/a/2020/014308, dated Sep. 11, 2024, 7 pages.
Office Action issued for Korean Patent Application No. 10-2021-7001554 dated May 29, 2023, 19 pages.

(Continued)

*Primary Examiner* — Uyen T Nguyen
(74) *Attorney, Agent, or Firm* — Husch Blackwell LLP

(57) ABSTRACT

An undergarment comprising a waistband and a body having a substantially hollow and columnar shape is provided. The body is configured to at least partially surround a torso of a user. The body includes a body panel, first and second leg portions, and first and second leg openings. At a front surface, the body further comprises an outwardly convex pouch. The pouch comprises a U-shaped bottom, fly panel, and center seam. At least two lateral side seams couple two lateral sides of the pouch to the body panel. The body further comprises a gusset portion that borders a portion of the U-shaped bottom and is coupled to the body panels. The gusset portion is configured to fit a curved shape of the user's body. The gusset portion and pouch are coupled together by a curved bottom seam adjacent to U-shaped bottom of the pouch.

20 Claims, 6 Drawing Sheets

(56) References Cited

U.S. PATENT DOCUMENTS

| | | | | |
|---|---|---|---|---|
| 7,017,193 | B2 | 3/2006 | Auger | |
| 2004/0154078 | A1* | 8/2004 | Auger | A41B 9/023 2/400 |
| 2007/0220660 | A1 | 9/2007 | Roesch et al. | |
| 2015/0320118 | A1 | 11/2015 | Frantz et al. | |
| 2016/0278438 | A1* | 9/2016 | Polidan | A41B 9/02 |
| 2016/0309792 | A1* | 10/2016 | Adriaansen | A41B 9/02 |
| 2017/0238619 | A1 | 8/2017 | Shupe et al. | |
| 2017/0290374 | A1* | 10/2017 | Biodrowski | A41B 9/02 |
| 2019/0116888 | A1* | 4/2019 | White | A41B 9/04 |

FOREIGN PATENT DOCUMENTS

| | | | |
|---|---|---|---|
| CN | 202697725 | U | 1/2013 |
| CN | 204861192 | U | 12/2015 |
| CN | 206062145 | U | 4/2017 |
| CN | 206150471 | U | 5/2017 |
| JP | 2005-264411 | A | 9/2005 |
| JP | 2008-196078 | A | 8/2008 |
| JP | 4246659 | B2 | 1/2009 |
| JP | 3215993 | U | 4/2018 |

OTHER PUBLICATIONS

First Office Action No. 93023 issued for Mexican Patent Application MX/a/2020/014308 dated Oct. 12, 2023, 8 pages.
Australian Examination Report Issued for Patent Application No. 2018428850, dated Feb. 28, 2024, 5 pages.
Examination Report Issued for Canadian Patent Application No. 3104613, dated Apr. 3, 2024, 6 pages.
Australian Examination Report Issued for Patent Application No. 2018428850, dated Jul. 9, 2024, 4 pages.
Japanese Office Action for Patent Application No. 2023-081883, dated Oct. 8, 2024, 3 pages.
Japanese Office Action for Japanese Patent Application No. 2023-081883, Dated Jan. 12, 2024, 2 Pages.
Australian Examination Report for Patent Application No. 2018428850, dated Feb. 4, 2025, 4 pages.
Office Action from corresponding Japanese Application No. 2025-003032, dated Jul. 29, 2025, 4 pages.
Office Action from corresponding Chinese Application No. 201880096748.2, dated Jan. 14, 2026, 18 pages.
Office Action for corresponding Japanese Application No. 2025-003032, dated Mar. 10, 2026, 6 pages.
Second Notice of Reexamination for corresponding Chinese Application No. 201880096748.2 dated May 21, 2026, 7 pages.

* cited by examiner

LOWER TORSO GARMENT INCLUDING A POUCH

CROSS-REFERENCE TO RELATED APPLICATIONS

This application claims priority to U.S. patent application Ser. No. 16/014,925, filed on Jun. 21, 2018, entitled "UNDERWEAR FOR MALES," currently pending, the entire disclosure of which is incorporated herein by reference.

TECHNICAL FIELD

This disclosure relates to undergarments, for example, undergarments for supporting external anatomy of a wearer.

BACKGROUND

Undergarments exist in a number of forms, such as boxer shorts, briefs, the combination boxer brief, base layer or thermal long underwear, and other undergarment types for all genders. Each style provides a different combination of fit, comfort, and support.

SUMMARY

This disclosure describes undergarments, particularly lower torso garments for supporting anatomy.

In one aspect, an undergarment is provided. The undergarment comprises a waistband and a body. The body has a substantially hollow and columnar shape and is configured to at least partially cover and adapt to a torso of a user. The body comprises a substantially continuous body panel. The body further comprises a first leg portion that includes a first leg opening and a second leg portion that includes a second leg opening. The first and second leg portions are substantially parallel to each other and are configured to receive legs of the user. The body yet further comprises an outwardly convex pouch. The pouch is positioned at a front surface of the body and is between the first and second leg portions. The pouch comprises a U-shaped bottom, a fly opening that extends through the pouch, and a center seam that extends upwardly from the U-shaped bottom until a bottom periphery of the waistband. In such embodiments, the pouch is coupled to the body panel at two lateral side of the pouch via at least two lateral side seams. The body further comprises a gusset portion that borders at least a portion of the U-shaped bottom of the pouch and is coupled to the body panel. The gusset portion is configured to fit a curved shape of the user's body. In such embodiments, the gusset portion and pouch are at least partially coupled together by a curved bottom seam adjacent to the U-shaped bottom of the pouch.

In other embodiments, the outwardly convex shape of the pouch provides a protrusion that may vary between at least zero inches to about 1 inch.

In yet other embodiments, the fly opening is positioned between two overlapping pieces of fabric of the pouch.

In some embodiments, the center seam of the pouch extends longitudinally along the pouch and biases the pouch to maintain the outwardly convex shape.

In other embodiments, the gusset portion comprises at least two gusset side seams at a front portion of the gusset that are disposed laterally outward from a lateral center. In such embodiments, the two gusset side seams form an ergonomic shape of the gusset such that the gusset provides support under external anatomy of the user.

In yet other embodiments, the gusset portion further comprises a rear seam.

In some embodiments, the curved bottom seam of the pouch is semicircular and forms the rounded, U-shaped bottom.

In other embodiments, the curved bottom seam comprises lock-stitching along at least a portion of a length of the curved bottom seam.

In yet other embodiments, the curved bottom seam transitions continuously to the lateral side seams. In such embodiments, the transition includes a gradual change in curvature between said curved bottom seam and said lateral side seams.

In another aspect, a lower torso garment adapted to be worn under at least one other garment and support external anatomy of a user is provided. The lower torso garment comprises a waist band and a body. The body has a substantially hollow and columnar shape and is configured to at least partially cover and adapt to a torso of a user. The body comprises a pouch positioned at a front surface of the body. The pouch comprises at least two lateral side seams extending downwardly from the waist band. The pouch further comprises a rounded bottom periphery. In such embodiments, a transition from the lateral side seams to the rounded bottom periphery is substantially continuous and includes a gradual change in curvature along a periphery of the pouch. A radius of curvature is defined by a first ratio of the rounded bottom periphery which is characterized by a different of length between a lateral radius of the rounded bottom periphery (A) and a longitudinal radius of the rounded bottom periphery (B). In such embodiments, the first ratio (A to B) is about 80% to about 120%. A curved length of the rounded bottom periphery (C) is characterized by being about 25% to about 38% of the length of a total periphery of the pouch. An outwardly convex shape of the pouch is defined by a second ratio which is characterized by a length between two opposite ends of the rounded bottom periphery (D). In such embodiments, the rounded bottom periphery (D) is a minimum distance of about 100% length up to about 250% length.

In other embodiments, the pouch further comprises a fly panel.

In yet other embodiments, the pouch further comprises a center seam.

In some embodiments, the lower body garment further comprises a gusset portion at least partially bordering the U-shaped bottom of the pouch. In such embodiments, the gusset portion is configured to fit a curved shape of the user's body.

In other embodiments, the gusset portion and pouch are at least partially connected by a curved bottom seam along the U-shaped bottom of the pouch.

In yet other embodiments, the lengths of the lateral radius (A) and longitudinal radius (B) are equal.

In some embodiments, the length of the lateral radius (A) and longitudinal radius (B) are different.

In other embodiments, the curved bottom seam comprises lock-stitching along at least a portion of a length of the curved bottom seam In yet other aspects, a lower torso garment adapted to be worn under at least one other garment and support external anatomy of a user is provided. The lower torso garment comprises a waistband. The lower torso garment further comprises a body extending from the waistband and having a substantially hollow and columnar shape. The body is configured to, at least partially, cover and adapt to a torso of a user. The body comprises an opening at a first, upper longitudinal end. The body further comprises a first leg portion and a second leg portion at a second, lower longitudinal end. The body yet further comprises a pouch positioned between the first leg portion and the second leg portion at a front surface of the body. The pouch is configured to hold and support external anatomy of a user. The pouch comprises a rounded bottom periphery at a lateral center and a lower longitudinal end of the pouch. In such embodiments, the rounded bottom periphery forms a U-shaped bottom. The pouch further comprises a curved bottom seam along the rounded bottom periphery. The pouch yet further comprises a first lateral side and a second lateral side extending towards the first, upper longitudinal end. The pouch comprises a first lateral side seam configured to couple the first lateral side to a body panel, and a second lateral side seam to couple the second lateral side to the body panel. The body portion further comprises a gusset portion positioned between the first leg portion and the second leg portion that extends from a periphery of the pouch. The gusset portion is configured to provide support under the external anatomy of the user. The gusset portion comprises a first gusset side seam and second side seams at a front of the gusset portion that each extend towards the second, lower longitudinal end. In such embodiments, the lower torso garment includes fabric comprising at least 5% spandex.

In some embodiments, the pouch is substantially symmetrical across a centerline extending longitudinally along the pouch through a lateral center of the pouch.

In other embodiments, the lateral side seams form a variety of shapes.

BRIEF DESCRIPTION OF THE DRAWINGS

Like reference numbers and designations in the various drawings indicate like elements.

DETAILED DESCRIPTION

This disclosure describes undergarments for males (e.g., men and boys), for example, undergarments to support a male anatomy during movement (e.g., everyday activity, exercise, and/or other) of a user of the undergarment. An example undergarment includes a front pouch portion and a gusset portion that allow for flexibility and comfort to a wearer of the undergarment. The front pouch portion has a U-shaped periphery with a rounded bottom periphery portion, and the front pouch portion is slightly wider near a bottom of the pouch than a top of the pouch. The gusset portion lines the rounded bottom periphery portion of the U-shaped periphery at the bottom of the pouch portion, where a sewn seam connecting the gusset portion and the pouch portion can include lock stitching. The 3D convex shaped pouch with U-shaped pouch periphery and connected shaped gusset provide more comfort for the wearer, for example, because the U-shape of the pouch more naturally surrounds and supports the male anatomy of the wearer, and provides a more ergonomic, customized fit that conforms to the body shape of the wearer. In some instances, the U-shaped pouch extends lower on the body of the wearer than conventional undergarment pouches, for example, to provide additional room for the male anatomy of the wearer and an ergonomic design of the pouch and gusset. In some examples, an undergarment with the disclosed pouch and gusset reduce a risk of chafing of the wearer by reducing friction between the male anatomy of the wearer and the body. For example, the convex pouch and U-shaped periphery forms a fabric barrier, increasing comfort and gives the support of a brief.

Figure 1:
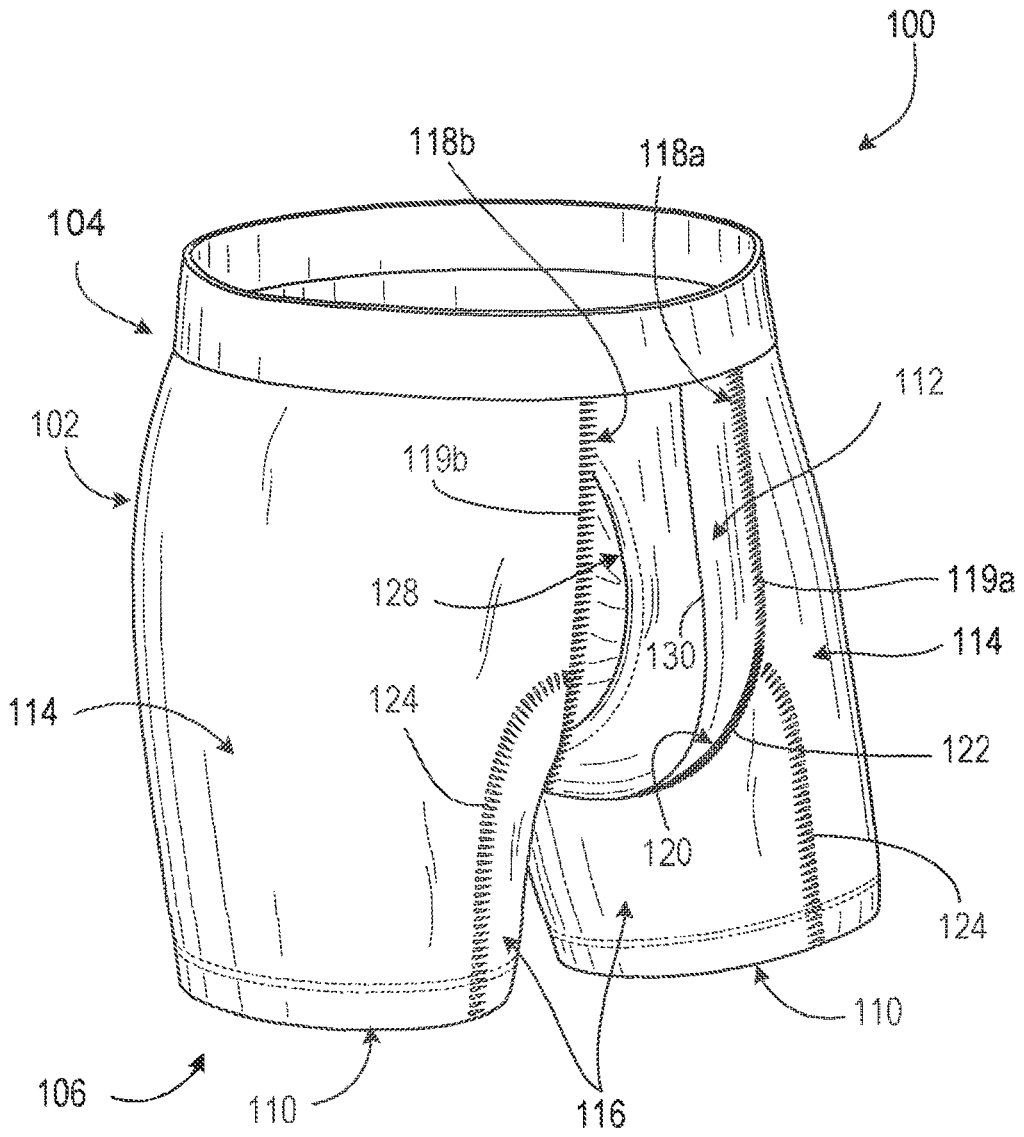
FIG. 1 is a front perspective view of an example undergarment.
Figure 2:
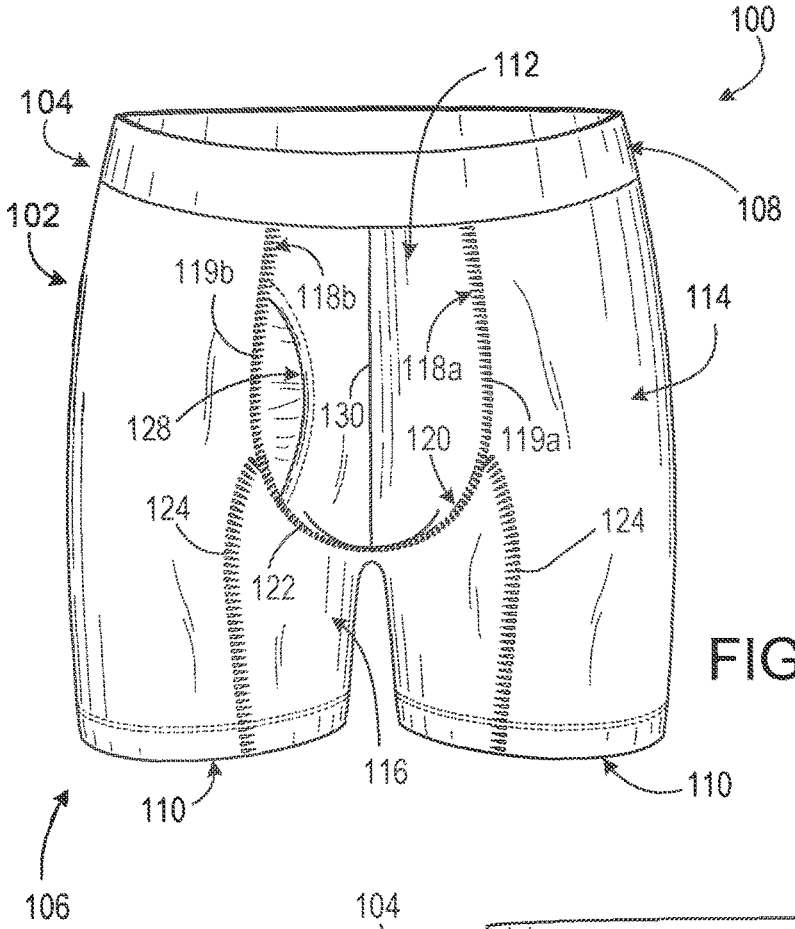
FIGS. 2 and 3 are a front view and a rear view of the example undergarment.
Figure 3:
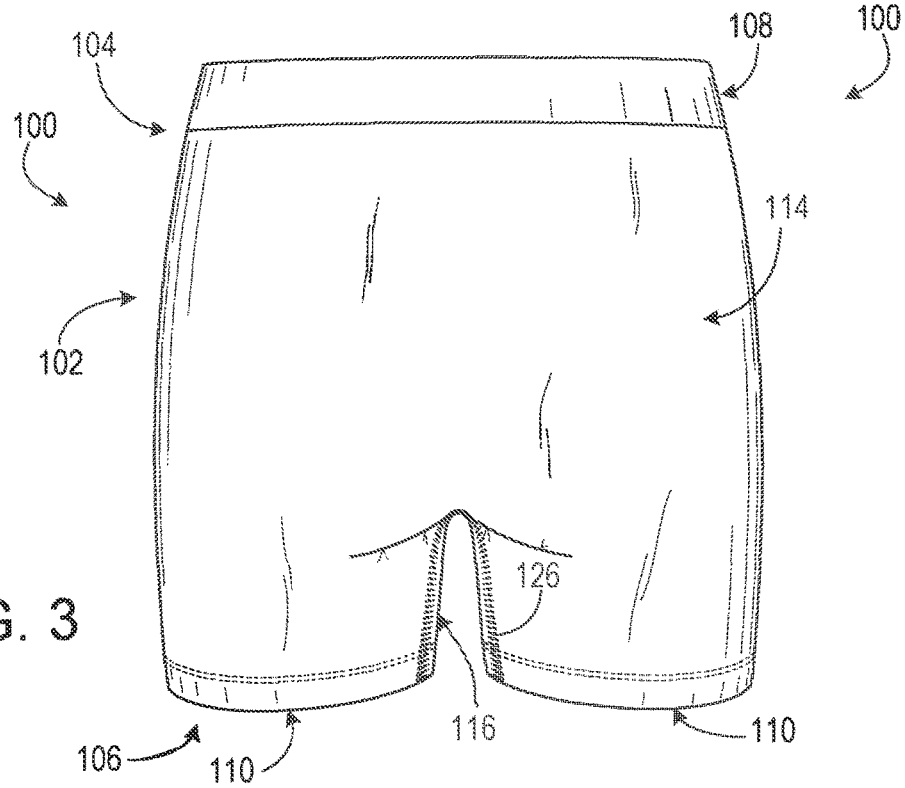
Figure 4A:
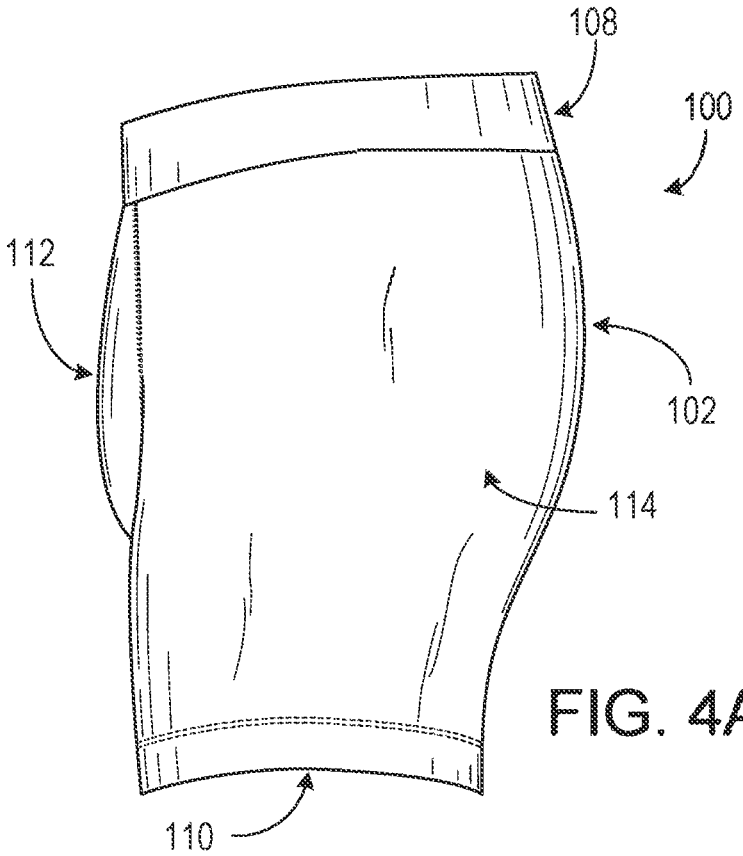
FIGS. 4A and 4B are a left side view and a right side view of the example undergarment.
Figure 4B:
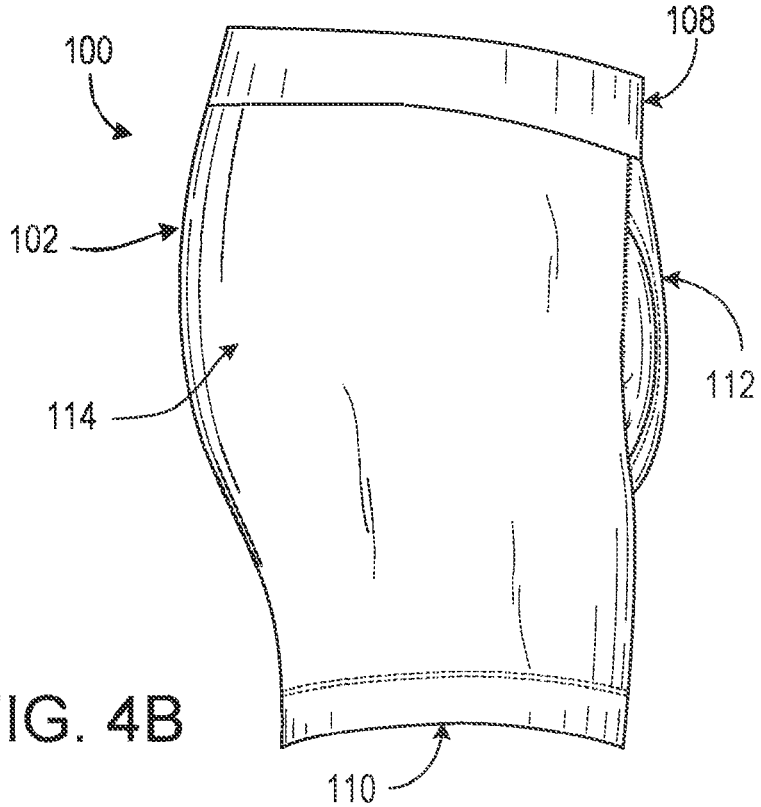
Figure 5A:
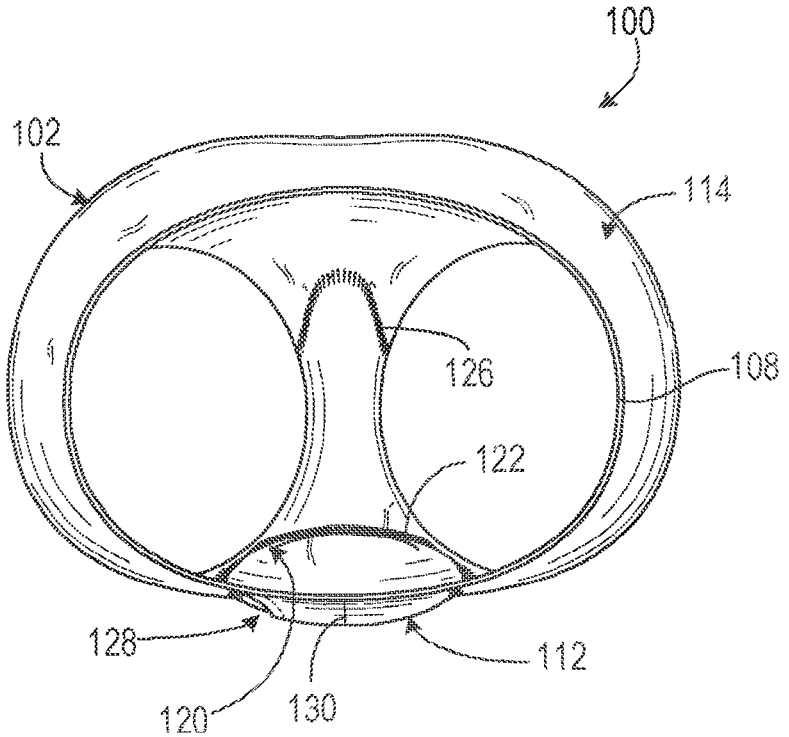
FIGS. 5A and 5B are a top view and a bottom view of the example undergarment.
Figure 5B:
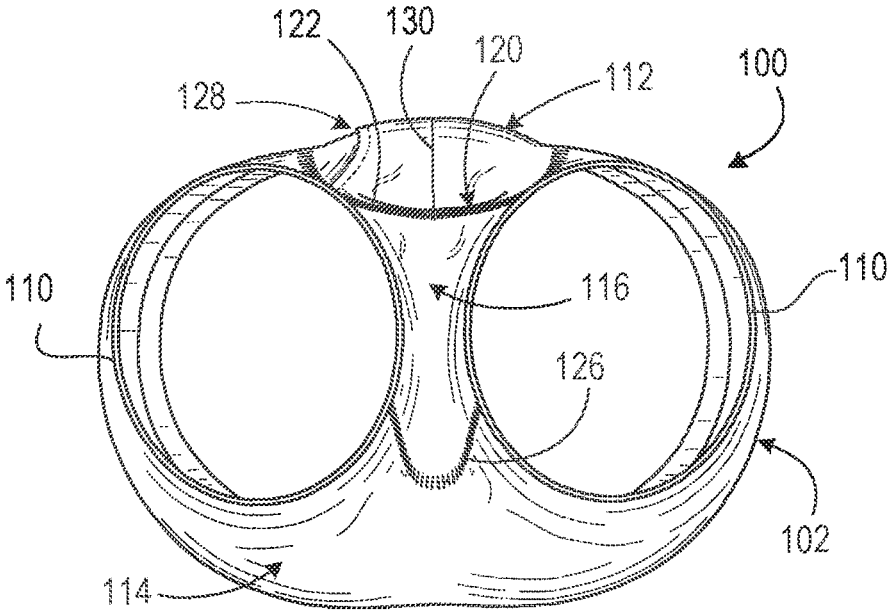

FIG. 1 is a front perspective view of an example undergarment 100, and FIGS. 2 and 3 are a front view and a rear view, respectively, of the example undergarment 100. The undergarment is shown as a mid-thigh boxer brief style undergarment. However, the example undergarment 100 can take on a variety of styles, such as briefs, boxers, trunks, low-thigh underwear, base layer or thermal long underwear, a liner for swimwear or running shorts, and/or other undergarment types. The example undergarment 100 includes a body 102 having a substantially tubular shape that surrounds, partially or completely, a torso of a wearer of the undergarment 100 at a first, upper longitudinal end 104 of the body 102. The example undergarment 100 also includes a waistband 108 connected to (e.g., adhered, sewn, integral with, and/or otherwise coupled to) the body 102 at the first, upper longitudinal end 104. In some examples, the waistband can include a covered elastic, or a turned-back self-fabric waistband that is an extension of the body 102. The body 102 forms leg portions 110 at a second, lower longitudinal end 106 of the body 102 opposite the first longitudinal end 104. In the present disclosure, a longitudinal direction is defined as a direction extending substantially between the first longitudinal end 104 and the second longitudinal end 106 of the body 102 (i.e., between the waistband 108 and the leg portions 110 along the body 102). Similarly, a lateral direction is defined as a direction extending substantially perpendicular to the longitudinal direction along, or tangential to, a surface of the body 102. FIGS. 4A and 4B are a left side view and a right side view of the example undergarment 100, and FIGS. 5A and 5B are a top view and a bottom view of the example undergarment 100.

The body 102 of the example undergarment 100 is formed from fabric portions coupled together to form the shape of the body 102. Referring to the example undergarment 100 of FIGS. 1-5B, the body 102 includes a pouch portion 112, a body panel 114, and a gusset portion 116. With a wearer wearing the undergarment 100, the pouch portion 112 is disposed adjacent to the male anatomy of the wearer, the gusset portion 116 is disposed at a crotch area of the wearer and at inner thigh portions of the legs of the wearer, and the body panel 114 forms the remainder of the body 102 and is disposed adjacent the upper legs (e.g., front, side, and rear thigh), buttocks, and sides of the torso of the wearer.

Figure 6A:
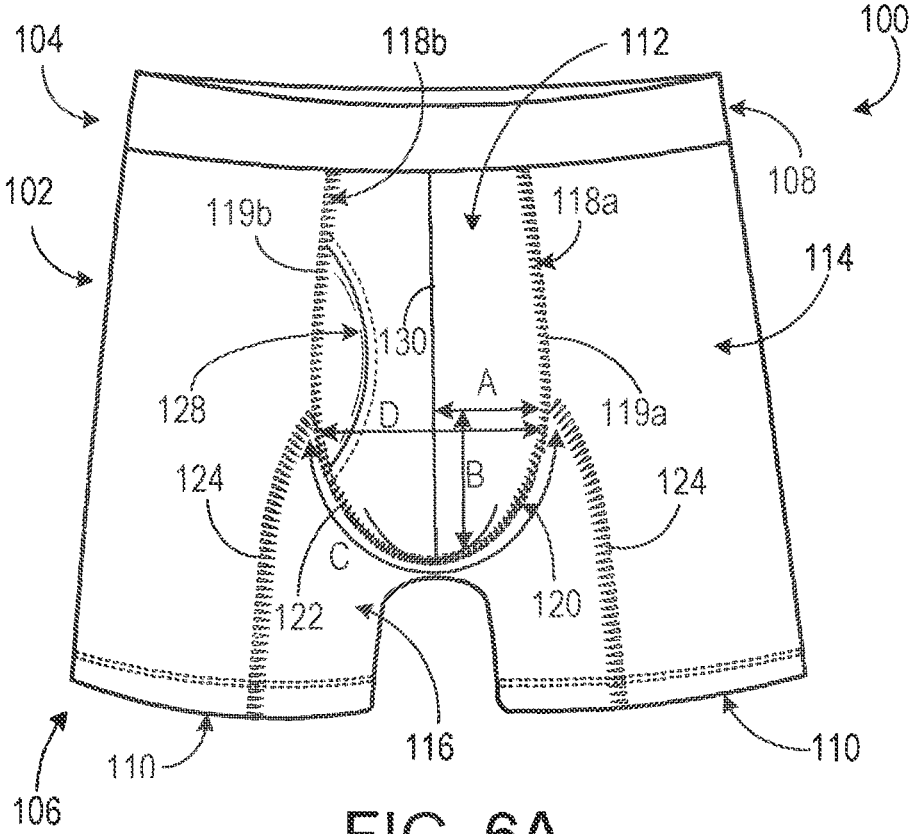
FIGS. 6A and 6B are a schematic front view and a schematic rear view, respectively, of an example undergarment.
Figure 6B:
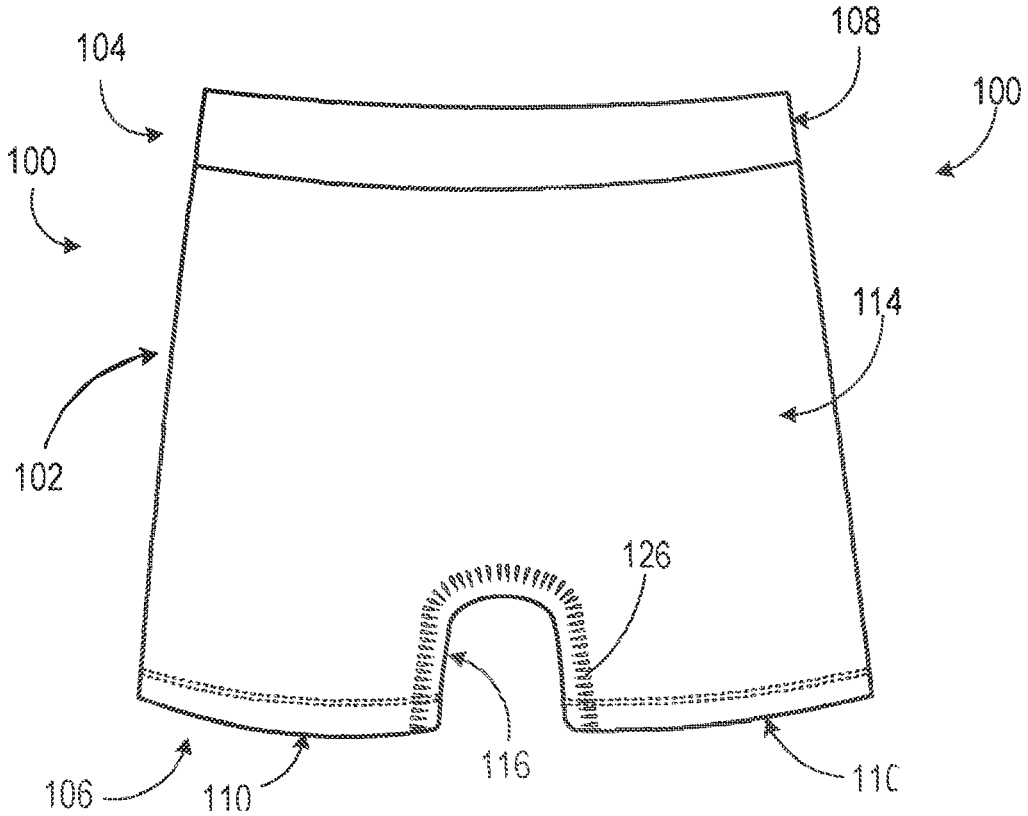

The pouch portion 112 of the example undergarment 100 is configured to be adjacent to the male anatomy of a wearer, The pouch portion 112 is a generally U-shaped panel disposed about a front surface of the body 102, where the pouch portion 112 connects to the body panel 114 of the body 102 at lateral sides (e.g., left lateral side 118*a* and right lateral side 118*b*) of the pouch portion 112. The pouch portion 112 is substantially symmetrical across a centerline extending longitudinally along the pouch portion 112 through a lateral center of the pouch portion 112. The pouch portion 112 has a rounded bottom periphery 120 at a lateral center and at a first longitudinal end of the pouch portion 112, shown in FIGS. 1 and 2 as the lower longitudinal end of the pouch 112. The rounded bottom periphery 120 forms the rounded, curved bottom of the U-shape of the pouch 112. In the example undergarment 100 of FIGS. 1-5B, the rounded bottom periphery 120 is semicircular, having a constant radius of curvature along at least a portion of (e.g., most of or all of) the length of the rounded bottom periphery 120. In some implementations, the rounded bottom periphery 120 can have a shape that is semicircular, semi-elliptical, parabolic, oval, arced (e.g., having a circular arc shape or elliptical arc shape between 20 degrees and 180 degrees), or another rounded shape. FIGS. 6A and 6B are a schematic front view and a schematic rear view, respectively, of the example undergarment 100. FIG. 6A includes labeled reference lengths A, B, C, and D, where A represents the lateral radius of the rounded bottom periphery 120, B represents the longitudinal radius of the rounded bottom periphery 120, C represents the curved length of the rounded bottom periphery 120, and D is the length of the fabric of the pouch 112 between approximate ends of the rounded bottom periphery 120. The lengths A and B can be the same or different. In some examples, the difference between radius B and radius A can range from 80% to 120%, where 80% means that lateral radius A is 80% of the length of longitudinal radius B, where 100% means that A and B are equal length (and the rounded bottom periphery 120 has a constant radius of curvature), and 120% means that lateral radius A is 120% of the length of longitudinal radius B. In certain examples, the length D can range from a minimum distance of 100% length (e.g., where the pouch 112 is flat and the distance D is represented by a straight line of fabric generally between ends of the rounded bottom periphery 120) up to 250% (e.g., where the pouch 112 is convex outward and the distance D is represented by a curved line of fabric with a length of 250% of the minimum length). For example, the outwardly convex shape of the pouch portion 112 can provide an outward protrusion of the pouch portion 112. The outward protrusion can vary in size, for example, between zero inches and one inch, such as 0.9 inches for a men's medium size boxer short.

The rounded bottom periphery 120 of the pouch portion 112 of the example undergarment 100 has a rounded shape that is continuous with the left lateral side 118*a* and right lateral side 118*b* of the pouch 112, which forms the U-shaped periphery of the pouch portion 112. In other words, the left lateral side 118*a*, rounded bottom periphery 120, and right lateral side 118*b* of the pouch 112 form a partial periphery of the pouch 112 that is continuous and has gradual change in curvature along the length of the periphery. The remainder of the periphery (e.g., other than the U-shaped partial periphery) of the pouch portion 112 borders the waistband 108. The partial periphery excludes acute angled transitions between the rounded bottom periphery 120 and the lateral sides 118*a* and 118*b*, and excludes acute discontinuities along the length of the rounded bottom periphery 120. For example, the transition between the bottom periphery 120 and the lateral sides 118*a* and 118*b* is continuous and gradual, where the rounded shape of the bottom periphery 120 gradually transitions (e.g., the radius of curvature gradually increases) to the shape (e.g., a curve or straight line) of the lateral sides 118*a* and 118*b*. The lateral sides 118*a* and 118*b* have a lesser degree of curvature than (e.g., a greater radius of curvature than) the rounded bottom periphery 120. In certain examples, the lateral sides 118*a* and 118*b* are substantially straight, where the U-shaped periphery of the pouch 112 has a radius of curvature that transitions from the sharper curve (e.g., smaller radius of curvature) of the rounded bottom periphery 120 to the straighter line or straighter curve (e.g., larger radius of curvature) of the lateral sides 118*a* and 118*b*.

In some implementations, the transition between the rounded bottom periphery 120 and the lateral sides 118*a* and 118*b* is defined by the point along the periphery of the pouch portion 112 where the radius of curvature changes. For example, the rounded bottom periphery 120 can include a semicircular shape with a constant or substantially constant radius of curvature along its length, as described earlier. The transition points can be defined as the ends of the rounded bottom periphery 120 where the radius of curvature increases from the radius of curvature of the semicircular shape (or other curved shape) toward the radius of curvature of the lateral sides 118*a* and 118*b*. The length of the rounded bottom periphery 120 can vary. For example, the rounded bottom periphery can have a length along its curve of between two inches and eight inches, such as six inches. In some implementations, the length of the rounded bottom periphery 120 (indicated in FIG. 6A as length "C") is between 24 percent (%) and 38% of the total U-shape periphery of the pouch portion 112 (e.g., from waistband point of left lateral side 118*a* to waistband point of right lateral side 118*b*). For example, the length of the rounded bottom periphery 120 can be about a third of (e.g., about 33% of) the total length of the U-shape periphery of the pouch 112.

The lateral sides 118*a* and 118*b* of the pouch portion 112 of the example undergarment 100 can take a variety of shapes. In FIG. 2, the lateral sides 118*a* and 118*b* are shown with a slight curve such that the lateral sides 118*a* and 118*b* curve inwardly toward the lateral center of the pouch portion 112 as the lateral sides 118*a* and 118*b* extend toward a second, upper longitudinal end of the pouch portion 112 (e.g., toward upper longitudinal end 104 of the body 102). However, the shape of the lateral sides 118*a* and 118*b* can be different. For example, the lateral sides 118*a* and 118*b* can be linear between ends of the rounded bottom periphery 120 and the upper longitudinal end 104 of the body 102 (i.e., at the waistband 108), can include a sharper curve along the length of the lateral sides 118*a* and 118*b* than shown in the example undergarment 100 of FIG. 2, can curve outwardly away from a lateral center of the pouch portion 112, or can take on different shapes.

In some implementations, a lateral width of the pouch portion 112 decreases from the transition point between ends the rounded bottom periphery 120 and the lateral sides 118*a* and 118*b* to the upper longitudinal end of the pouch portion 112. For example, a first lateral width of the pouch portion 112 in a longitudinally lower half of the pouch portion 112, such as the lateral width between upper ends of the rounded bottom periphery 120, is greater than a second lateral width of the pouch portion 112 in a longitudinally upper half of the pouch portion 112, where the lateral width is measured between the lateral sides 118*a* and 118*b* of the pouch portion 112. The shape of the pouch portion 112, such as having a lower lateral width that is greater than an upper lateral width, can provide enhanced fit and comfort to a wearer of the undergarment, as described in more detail later.

Lateral side seams (i.e., left lateral side seam 119*a* and right lateral side seam 119*b*) connect the lateral sides 118*a* and 118*b* of the pouch portion 112 of the example undergarment 100 to the body panel 114. The body panel 114 extends from the left lateral side 118*a* of the pouch 112 laterally along the body 102 to a rear of the body 102, and further extends back around to the front surface of the body 102 and to the right lateral side 118*b* of the pouch 112. The body panel 114 substantially surrounds the wearer of the undergarment 100. The body panel 114 and the pouch 112, when connected together (e.g., with lateral side seams 119*a* and 119*b*), are configured to completely surround the wearer. In FIGS. 1 to 6B, the body panel 114 is shown as a substantially continuous fabric panel without seams or other discontinuities along its lateral length extending from the left lateral side seam 119*a* around the rear of the body 102 and to the right lateral side seam 119*b*. However, the body panel 114 can take a variety of forms, and can include intermittent seams, fused fabric connections, cut-and-sew fabric pieces, or other discontinuities in the body panel 114. For example, the body panel 114 can be formed of multiple fabric pieces knit together, sewn together, and/or otherwise coupled together to form the remainder of the body 102 (other than the pouch portion 112 and gusset portion 116).

The gusset portion 116 of the example undergarment 100 is a fabric panel that extends between the leg portions 110 and connects to the body panel 114 to form part of the second, lower longitudinal end 106 of the body 102. The gusset portion 116 also at least partially borders the rounded bottom periphery 120 of the pouch 112. A curved bottom seam 122 connects the pouch portion 112 to the gusset portion 116 along all or a portion of the rounded bottom periphery 120 of the pouch portion 112. The gusset portion 116 also connects to the body panel 114 with gusset side seams 124. The gusset side seams 124 are disposed at a front of the gusset portion 116, and extend from the periphery of the pouch portion 112 to the lower longitudinal end 106 of the body 102. In some implementations, the gusset side seams 124 connect to the pouch portion 112 at the intersection of the lateral side seams 119*a* and 119*b* and the curved bottom seam 122.

The gusset portion 116 also includes a rear seam 126 that connects to the body panel 114 at a rear of the undergarment 100. The rear seam 126 is an arch shape, or upside-down U-shape. In certain instances, the gusset portion 116 connects to the body panel 114 at the gusset side seams 124 and the rear seam 126 to form the substantially cylindrical, tubular shape of the leg portions 110 at the second longitudinal end 106 of the body 102. Each of the leg portions 110 has a leg opening at the second longitudinal end 106 of the body 102, defined in part by the body panel 114 and the gusset portion 116 connected together by the side seams 124 and the rear seam 126. The gusset portion 116 has an ergonomic shape between the leg openings, for example, to better fit the curved shape of the body of the wearer of the undergarment 100. The gusset side seams 124 are disposed and extend more laterally outward from a lateral center of the undergarment 100 than the rear seam 126. In some instances, a front area of the gusset portion 116 (e.g., the portion of the gusset portion 116 on the front half of the undergarment 100) is greater than a rear area of the gusset portion 116 (e.g., the portion of the gusset portion 116 on the rear half of the undergarment 100).

The example undergarment 100 can be used by male wearers. As such, the pouch portion 112 can be configured to receive and support the male anatomy of the wearer. In some instances, the curved bottom seam 122 includes extra lock stitching, for example, to provide a more robust connection between the pouch portion 112 and the gusset portion 116 and to provide additional support under the male anatomy of a wearer when the undergarment 100 is being worn by the wearer. In some instances, the lock stitching reduces or restricts stretch in the bottom seam 122 to stabilize the bottom seam 122, and/or reduces or restricts movement in the bottom of the pouch portion 112 or the gusset portion 116 (or both) proximate to the curved bottom seam 122 to add further support under the male anatomy of the wearer of the undergarment 100. The lock stitching can extend along a portion of or the entirety of the length of the curved bottom seam 122, for example, between the gusset side seams 124.

In some implementations, the pouch portion 112 of the example undergarment 100 includes a fly opening 128. The fly opening 128 can be formed by a partial overlap of two pieces of fabric that make up the pouch portion 112. In other implementations, the fly opening 128 can be excluded, and the pouch portion 112 can be formed of one or more fabric panels extending from the left lateral side 118*a* to the right lateral side 118*b* of the pouch portion 112 without an opening.

The pouch portion 112 of the example undergarment 100 is configured to form an outwardly extending convex shape, which forms a pouch-like pocket to hold and support the male anatomy of a wearer of the undergarment 100. In some implementations, the pouch portion 112 includes a center seam 130 extending longitudinally along the pouch portion 112 at a lateral center of the pouch portion 112. The center seam 130 extends longitudinally from the first, lower longitudinal end of the pouch portion 112 to the second, upper longitudinal end of the pouch portion 112. The center seam 130 can bias the pouch portion 112 to create and maintain its convex shape, and in some instances, can provide additional support and strength to the pouch portion 112. For example, some implementations of the pouch portion 112 include two conversely curving pouch pattern pieces sewn together with the center seam 130, and the center seam 130 can promote the 3D, convex shape of the pouch portion 112 from the two curving pouch pieces. In some implementations, the center seam 130 can include (or be replaced with) a dart, or the pouch 112 can exclude the center seam altogether. The shape of the pouch portion 112, such as having a lower lateral width that is greater than an upper lateral width, can provide enhanced fit and comfort to a wearer of the undergarment. For example, the wider bottom portion of the pouch 112 in conjunction with the curved, convex shape of the pouch 112 and the center seam 130 creates a 3D pouch shape to hold the male anatomy. As the pouch 112 is filled or formed by the male anatomy of a wearer, the lateral side seams 119*a* and 119*b* straighten, which can help position the fly opening 128 in a position for functional fly use.

The body 102 of example undergarment 100 can be formed from a number of different materials and fabrics, such as elastomeric or stretch knitted fabric. Such fabrics can be made by varying combinations of cotton, polyester, nylon, spandex, viscose, modal, lyocel, and/or rayon fiber yarns, for example, to provide softness, comfort, and desired stretch properties. The fabrics can be knit in a variety of knit types, such as jersey, rib, mesh, and/or other knit textures and structures. For example, the body 102 of example undergarment 100 can be formed from stretch fabric having no less than 1% spandex (for example, at least 5% spandex) to provide flexibility to the fabric and comfort to the wearer. In some implementations, the fabric is a knit fabric having a mechanical stretch to provide a factor of stretchability to the fabric. Mechanical stretch can be defined as a knitting structure of a fabric that creates extra give through the gauge of the knitting, through texture (e.g., a rib structure), or both. For example, a fabric knit with a fine rib pattern can provide mechanical stretch to the fabric.

Figure 7:
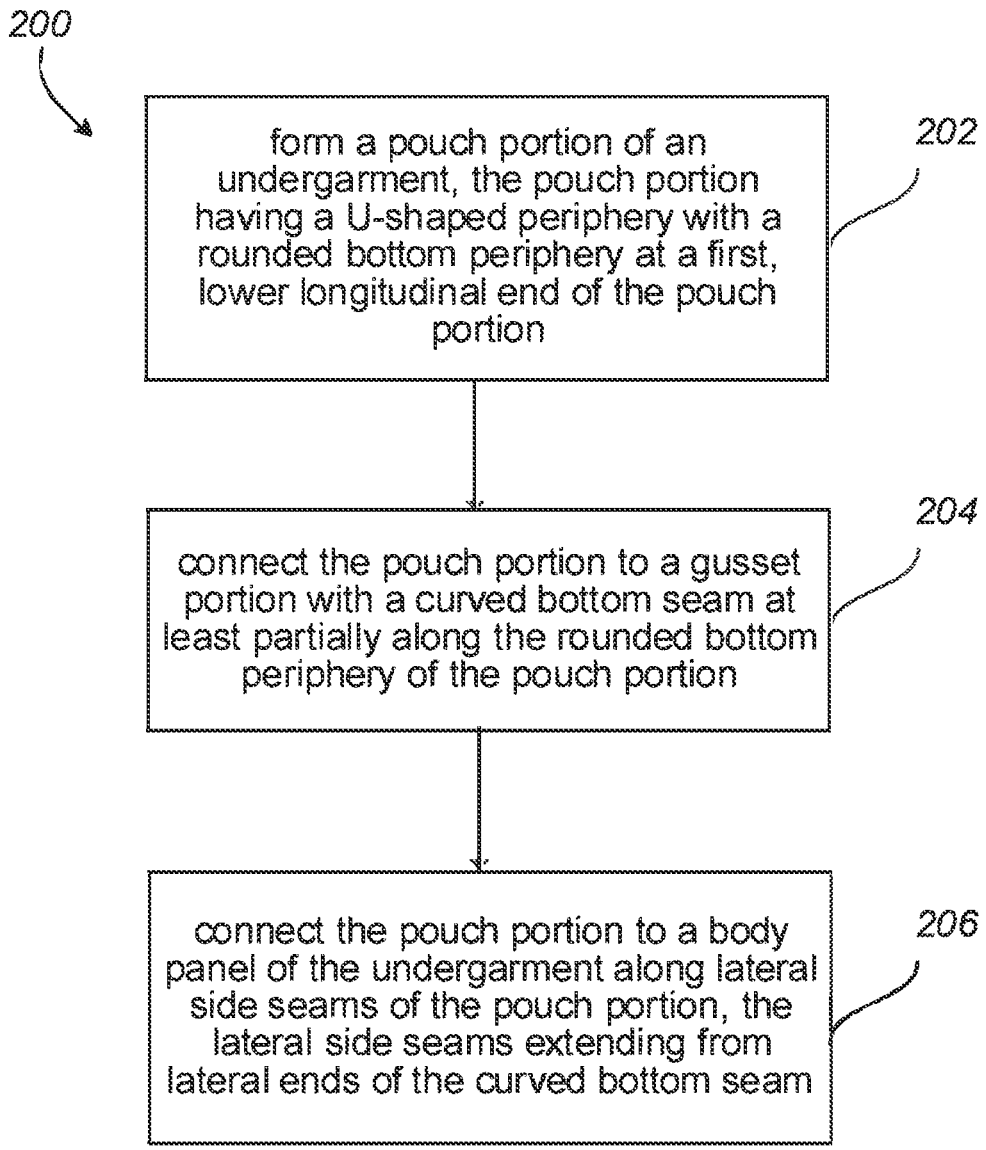
FIG. 7 is a flowchart of an example method of making an undergarment.

FIG. 7 is a flowchart describing an example method 200 of making an undergarment, for example, the example undergarment 100 of FIGS. 1-6B. At 202, a pouch portion of an undergarment is formed, where the pouch portion has a rounded, U-shaped periphery at a first, lower longitudinal end of the pouch portion. At 204, the pouch portion is connected to a gusset portion with a curved bottom seam at least partially along the U-shaped periphery of the pouch portion. At 206, the pouch portion is connected to a body panel of the undergarment along lateral side seams of the pouch portion, the lateral side seams extending from lateral ends of the curved bottom seam. The order of construction of the undergarment can vary. In some implementations, the undergarment 100 can be formed by first constructing the pouch portion 112 (e.g., sewing fabric panels together at center seam 130 to form the pouch portion 112), then attaching the gusset portion 116 to the body panel 114 at the front of the leg portions 110 (e.g., at the gusset side seams 124), then attaching the pouch portion 112 to the body panel 114 and the gusset portion 116, optionally lock-stitching the curved bottom seam 122 at the rounded bottom periphery 120, and then sewing the gusset 116 to the body panel 114 at the rear of the garment (e.g., at rear gusset seam 126).

A number of implementations have been described. Nevertheless, it will be understood that various modifications may be made without departing from the spirit and scope of the disclosure.

What is claimed is:

1. An undergarment, comprising:

a waistband; and a body having a substantially hollow and columnar shape configured to at least partially cover and adapt to a shape of a lower torso of a wearer, the body comprising:

a substantially continuous body panel;

a first leg portion including a first leg opening and a second leg portion including a second leg opening, each of the first leg opening and the second leg opening configured to receive legs of the wearer;

a pouch that is substantially U-shaped and imparted with an outwardly convex shape, the pouch positioned on a front surface of the body panel disposed between the first leg portion and the second leg portion, the pouch coupled to the body panel via at least two curved lateral side seams, the pouch comprising:

a rounded bottom periphery;

wherein a radius of curvature of the rounded bottom periphery is characterized by a difference between a lateral radius of the rounded bottom periphery (A) and a longitudinal radius of the rounded bottom periphery (B), wherein a ratio of A to B is about 80% to about 120%;

wherein a curved length of the rounded bottom periphery (C) is characterized by being about 25% to about 38% of a total length of a periphery of the pouch;

a center seam extending upwardly from the rounded bottom periphery and to a bottom periphery of the waistband; and a gusset bordering at least a portion of the rounded bottom periphery of the pouch and coupled to the body panel, the gusset configured to fit a curved shape of the wearer's body, and wherein the gusset and the pouch are coupled via a curved bottom seam positioned and located adjacent to the rounded bottom periphery of the pouch;

wherein the curved bottom seam includes additional lock stitching designed to reduce a stretch of the curved bottom seam.

2. The undergarment of claim 1, wherein the outwardly convex shape of the pouch provides a protrusion that projects a first length outwardly, and wherein the first length is about zero inches to about 1 inch.

3. The undergarment of claim 1, wherein the pouch further includes two overlapping pieces of fabric and wherein a fly opening is formed by the two overlapping pieces of fabric.

4. The undergarment of claim 1, wherein the center seam of the pouch extends longitudinally along the pouch and biases the pouch to maintain the outwardly convex shape.

5. The undergarment of claim 1, wherein:

the gusset comprises at least two gusset side seams located at a front portion of the gusset, the at least two gusset side seams are disposed laterally outward from a lateral center of the undergarment, the at least two gusset side seams connect to the pouch proximate to an intersection of the at least two curved lateral side seams and the curved bottom seam, and the at least two gusset side seams form an ergonomic shape of the gusset such that the gusset provides support to external anatomy of the wearer.

6. The undergarment of claim 1, wherein the gusset further comprises:

at least two curved gusset side seams disposed about a front portion of the gusset; and a curved rear seam that couples to the body panel.

7. The undergarment of claim 1, wherein the additional lock stitching extends along at least a portion of a length of the curved bottom seam.

8. The undergarment of claim 1, wherein:

a transition between the curved bottom seam and the at least two curved lateral side seams is continuous, and the transition between the curved bottom seam and the at least two curved lateral side seams excludes acute angles.

9. A lower torso garment adapted to be worn under at least one other garment and support external anatomy of a user, the lower torso garment comprising:

a waistband; and a body configured to cover at least a portion of a torso of the user, the body comprising:

a pouch positioned at a front surface of the body, the pouch comprising:

at least two lateral side seams extending downwardly from the waistband; and a rounded bottom periphery, wherein a transition from the at least two lateral side seams to the rounded bottom periphery is substantially continuous and includes a gradual change in curvature along a periphery of the pouch;

wherein a radius of curvature of the rounded bottom periphery is characterized by a difference between a lateral radius of the rounded bottom periphery (A) and a longitudinal radius of the rounded bottom periphery (B), wherein a ratio of A to B is about 80% to about 120%;

wherein a curved length of the rounded bottom periphery (C) is characterized by being about 25% to about 38% of a total length of the periphery of the pouch, the periphery of the pouch defined by the at least two lateral side seams and the rounded bottom periphery; and wherein an outwardly convex shape of the pouch is characterized by a first length between two opposite ends of the rounded bottom periphery, and wherein a second length of the rounded bottom periphery (D) is about 100% to about 250% of the first length.

10. The lower torso garment of claim 9, wherein the lower torso garment further includes a gusset positioned adjacent to the rounded bottom periphery.

11. The lower torso garment of claim 10, wherein the pouch includes a top portion positioned adjacent to the waistband and a bottom portion proximate to the gusset and the pouch is imparted with a larger width at the bottom portion than the top portion.

12. The lower torso garment of claim 9, wherein the lower torso garment further comprises a gusset portion at least partially bordering the rounded bottom periphery of the pouch, the gusset portion configured to fit a curved shape of a body of the user.

13. The lower torso garment of claim 9, wherein the lower torso garment further comprises a gusset and wherein the gusset and the pouch are at least partially connected by a curved bottom seam along the rounded bottom periphery of the pouch.

14. The lower torso garment of claim 9, wherein A and B are equal.

15. The lower torso garment of claim 9, wherein A and B are different.

16. The lower torso garment of claim 9, wherein the lower torso garment further comprises a curved bottom seam, and wherein the curved bottom seam comprises lock stitching along at least a portion of the curved bottom seam.

17. A boxer brief configured to support external anatomy of a user, the boxer brief comprising:

a waistband; and a body extending downwardly from the waistband and having a substantially hollow and cylindrical shape, the body configured to at least partially adapt to a physique of the user, the body comprising:

an opening at a first, upper longitudinal end of the body;

a first leg portion and a second leg portion, the first leg portion and the second leg portion positioned and located at a second, lower longitudinal end of the body; and a pouch configured to hold and support the external anatomy of the user, the pouch comprising:

a rounded bottom periphery;

wherein a radius of curvature of the rounded bottom periphery is characterized by a difference between a lateral radius of the rounded bottom periphery and a longitudinal radius of the rounded bottom periphery, wherein a ratio of the lateral radius of the rounded bottom periphery to the longitudinal radius of the rounded bottom periphery is about 80% to about 120%;

wherein a curved length of the rounded bottom periphery is characterized by being about 25% to about 38% of a total length of a periphery of the pouch;

a curved bottom seam along the rounded bottom periphery;

a first lateral side and a second lateral side extending toward the first, upper longitudinal end; and a first lateral side seam coupling the first lateral side to the body, and a second lateral side seam coupling the second lateral side to the body; and a gusset portion positioned between the first leg portion and the second leg portion and extending from the periphery of the pouch, the gusset portion is configured to provide support to the user;

wherein the pouch and the gusset portion form a fabric barrier designed to reduce friction between external anatomy of a wearer and surrounding regions of a body of the wearer.

18. The boxer brief of claim 17, wherein the pouch is substantially symmetrical across a centerline extending longitudinally along the pouch through a lateral center of the pouch.

19. The boxer brief of claim 17, wherein the periphery of the pouch includes the rounded bottom periphery, the first lateral side, and the second lateral side, and wherein the total length of the periphery of the pouch is about 6 inches to about 34 inches.

20. The boxer brief of claim 17, wherein the boxer brief includes a fabric comprising at least about 5% spandex.

* * * * *